US007187283B2

(12) United States Patent
Leyden et al.

(10) Patent No.: US 7,187,283 B2
(45) Date of Patent: Mar. 6, 2007

(54) SECURITY SYSTEM FOR A PORTABLE ARTICLE

(75) Inventors: Roger Leyden, Inverness, IL (US); Michael Parent, Palatine, IL (US); Bjarne Fredericksen, Lombard, IL (US)

(73) Assignee: Se-Kure Controls, Inc., Franklin Park, IL (US)

( * ) Notice: Subject to any disclaimer, the term of this patent is extended or adjusted under 35 U.S.C. 154(b) by 285 days.

(21) Appl. No.: 10/964,132

(22) Filed: Oct. 13, 2004

(65) Prior Publication Data

US 2005/0206522 A1 Sep. 22, 2005

Related U.S. Application Data

(63) Continuation-in-part of application No. 10/803,397, filed on Mar. 18, 2004.

(51) Int. Cl.
*G08B 13/14* (2006.01)

(52) U.S. Cl. ..... 340/568.1; 340/568.2; 340/571

(58) Field of Classification Search ..... 340/568.1, 340/568.2, 568.3, 568.8, 571, 687
See application file for complete search history.

(56) References Cited

U.S. PATENT DOCUMENTS

| | | | | |
|---|---|---|---|---|
| 3,938,124 | A | 2/1976 | Way et al. | |
| 5,331,306 | A | 7/1994 | Carruthers, II | |
| 5,408,213 | A | 4/1995 | Ungarsohn | |
| 5,648,757 | A | 7/1997 | Vernace et al. | |
| 5,656,996 | A | 8/1997 | Houser | |
| 5,676,258 | A | 10/1997 | Leyden et al. | |
| 6,087,939 | A * | 7/2000 | Leyden et al. | 340/568.2 |
| 6,177,869 | B1 | 1/2001 | McDaid | |
| 6,236,312 | B1 | 5/2001 | Chitsazan et al. | |
| 6,243,005 | B1 | 6/2001 | Haimovich et al. | |
| 6,326,890 | B1 | 12/2001 | Costa | |
| 6,380,855 | B1 | 4/2002 | Ott | |
| 6,476,717 | B1 * | 11/2002 | Gross et al. | 340/568.1 |
| 6,700,488 | B1 | 3/2004 | Leyden et al. | |
| 6,756,900 | B2 * | 6/2004 | Leyden et al. | 340/568.4 |
| 6,956,479 | B2 * | 10/2005 | Kelsch et al. | 340/568.1 |
| 7,079,031 | B2 * | 7/2006 | Ott | 340/568.2 |

* cited by examiner

*Primary Examiner*—John Tweel, Jr.
(74) *Attorney, Agent, or Firm*—Wood, Phillips, Katz, Clark & Mortimer

(57) ABSTRACT

The combination of a portable article, a first support assembly, and a tethering system. The first support assembly has at least a first connecting element for maintaining the portable article in a secured state relative to the first support assembly. The tethering system connects to the first support assembly and is connectable to a base/support. The tethering system prevents the first support assembly from being moved beyond a predetermined range from a base/support to which the tethering system is connected. The combination further includes an alarm system. The alarm system is capable of detecting at least (a) a first state wherein at least one of the tethering system and alarm system has been reconfigured to allow the portable article, in the secured state relative to the first support assembly, to be moved beyond the predetermined range away from a base/support, and (b) a second state wherein at least one of the tethering system and alarm system has been reconfigured to allow the portable article to be changed from the secured state relative to the first support assembly and moved beyond the predetermined range away from a base/support.

24 Claims, 5 Drawing Sheets

ALARM SYSTEM 20
BASE/ SUPPORT 18
28
32
66'
88
12
112
136
148
150
30
166
16
134
66''
32
66'''

SECURITY SYSTEM FOR A PORTABLE ARTICLE

CROSS-REFERENCE TO RELATED CASE

This application is a continuation-in-part of U.S. application Ser. No. 10/803,397 filed Mar. 18, 2004 entitled "Security System for Portable Articles".

BACKGROUND OF THE INVENTION

1. Field of the Invention

This invention relates to security systems and, more particularly, to a security system that is usable to confine movement of a portable article to within a prescribed space.

2. Background Art

The use of "hands on" displays at points of purchase is becoming more and more popular, particularly in the electronics industry. Electronic devices are becoming more and more sophisticated, with a wide range of capabilities and features. Given the considerable potential investment in these devices, consumers have come to expect that they will be given the opportunity to hold and operate the devices as they would in the event of purchase. This is true of, among other types of products, cellular telephones, personal digital assistant devices (PDA's), digital music players, etc.

It is impractical for potential customers to be given devices, one-by-one, and for any handling thereof to be monitored, as by a sales person. First of all, this practice could potentially require an inordinately large number of personnel, depending upon the number of products to be displayed and number of shoppers. Secondly, it is impractical to expect a sales force to keep track of all individual devices that are made available to prospective purchasers. This type of an environment is particularly attractive to thieves, recognizing that tracking of all devices made available to prospective consumers would be difficult, if not impossible. While safeguards have been devised at exits, through electronic sensing and/or strategic placement of security personnel and inspection of departing patrons, to a sophisticated thief, these normal safeguards may represent an insignificant impediment to theft.

Thus, the trend in the electronics industry has been to display most available products for inspection without requiring supervision by store personnel. One such system is shown in U.S. Pat. No. 6,700,488, which is commonly owned by the Assignee herein. The system shown in that patent utilizes a wall, at which portable articles are presented. A series of holding elements are utilized to maintain each article in a secured state. The wall is in turn tethered to a base/support. The length of the tether dictates the permissible range of movement by a prospective purchaser relative to the base/support. A would-be thief might attempt to defeat the system shown in this patent primarily in one of two ways. First, the wall, with the portable article in a secured state thereon, might be separated from the base/support, as by severing the tethering arrangement. Second, the would-be thief might attempt to separate the portable article from the wall and associated holding elements. Ideally, the system is configured so that either of these attempted breaches can be prevented or, if not prevented, detected.

SUMMARY OF THE INVENTION

In one form, the invention is directed to the combination of a portable article, a first support assembly, and a tethering system. The first support assembly has at least a first connecting element for maintaining the portable article in a secured state relative to the first support assembly. The tethering system connects to the first support assembly and is connectable to a base/support. The tethering system prevents the first support assembly from being moved beyond a predetermined range from a base/support to which the tethering system is connected. The combination further includes an alarm system. The alarm system is capable of detecting at least (a) a first state wherein at least one of the tethering system and alarm system has been reconfigured to allow the portable article, in the secured state relative to the first support assembly, to be moved beyond the predetermined range away from a base/support, and (b) a second state wherein at least one of the tethering system and alarm system has been reconfigured to allow the portable article to be changed from the secured state relative to the first support assembly and moved beyond the predetermined range away from a base/support.

The tethering system may include a first elongate flexible element and may be provided in combination with a base/support having a housing with an associated mechanism for retracting the first elongate flexible element into the housing for thereby changing a distance between the housing and the portable article and first support assembly, with the portable article in the secured state relative to the first support assembly.

The mechanism associated with the housing may have a reel that is normally biased in rotation around an axis so that the first elongate flexible element is caused to be wrapped around the reel to be retracted into the housing.

In one form, the alarm system defines a part of the tethering system.

The alarm system may have a detectable signal generator and a conductive element that defines a conductive path that, if interrupted, causes the detectable signal generator to generate a detectable signal indicative of a system breach.

The alarm system may include a sensor with a secured state and an unsecured state. With the sensor attached to the portable article, the sensor is in the secured state. With the sensor separated from the portable article, the sensor is in the unsecured state.

The first support assembly may have a first wall at which the portable article is placed with the portable article in its secured state. In one form, the conductive element is directed through the first wall in the first support assembly.

In one form, the first connecting element has a surface which blocks the portable article from being separated from the first wall.

The tethering system may include a mechanical cable, which is independent of the conductive element. The mechanical cable connects to the first support assembly and is connectable to a base/support.

In one form, the mechanical cable and conductive element each have a length, and the mechanical cable and conductive element are joined to each other over at least a portion of the lengths of the mechanical cable and conductive element.

In one form, the first connecting element is movable relative to the first wall between an unsecured position and secured position. In the unsecured position, the surface on the first connecting element blocks the portable article from being separated from the first wall. In the unsecured position, the surface on the first connecting element does not block the portable article from being separated from the first wall. The first support assembly may further have a setting mechanism that can be placed selectively in a holding state and a release state. The setting mechanism in the holding state maintains the first connecting element in the secured position. The setting mechanism in the release state allows the first connecting element to be changed from the holding position into the release position.

The first support assembly may include a second connecting element that cooperates with the first connecting element to maintain the portable article in the secured state.

The first support assembly may further include an access assembly that is changeable between a first state and a second state. The access assembly in the first state blocks access to the setting mechanism to prevent the setting mechanism from being changed from the holding state into the release state. The access assembly in the second state permits access to the setting mechanism to allow the setting mechanism to be changed from the holding state into the release state.

The access assembly may include a second wall that is connected to the first wall with the access assembly in the first state.

In one form, with the first wall connected to the second wall, a chamber is defined between the first and second walls. The setting mechanism resides at least partially in the chamber.

In one form, the tethering system includes a mechanical cable, independent of the conductive element, which connects to the first support assembly within the chamber and is connectable to a base/support.

The combination may further include a base/support to which the tethering system connects.

In one form, the first connecting element has an L shape with first and second transverse legs, and the first leg defines the surface.

The first connecting element may have an L shape with first and second traverse legs, with the first leg attached to the first wall and the second leg blocking shifting of the portable article relative to the first wall.

In one form, the first connecting element has a U shape with spaced, substantially parallel, first and second legs. With the portable article in the secured state, the portable article resides between the first and second legs.

The tethering system may further include a mechanical cable that is connected to the first support assembly in the chamber.

In one form, with the portable article in the secured state, at least a part of the portable article is spaced from a part of the first wall. The sensor resides at least partially in a space defined between the part of the portable article and part of the first wall.

The invention is further directed to a security system for a portable article. The system has a first support assembly with at least a first connecting element for maintaining a portable article in a secured state relative to the first support assembly. A tethering system connects to the first support assembly and is connectable to a base/support. The tethering system prevents the first support assembly from being moved beyond a predetermined range from a base/support to which the tethering system is connected. The combination may further include an alarm system capable of detecting at least (a) a first state wherein at least one of the tethering system and alarm system has been reconfigured to allow the first support assembly to be moved beyond the predetermined range away from the base/support, and (b) a second state wherein at least one of the tethering system and alarm system has been reconfigured to allow a portable article to be changed from the secured state relative to the first support assembly to be moved beyond the predetermined range away from a base/support.

The security system may further include a base/support to which the tethering system is connected.

DETAILED DESCRIPTION OF THE DRAWINGS

Figure 1:
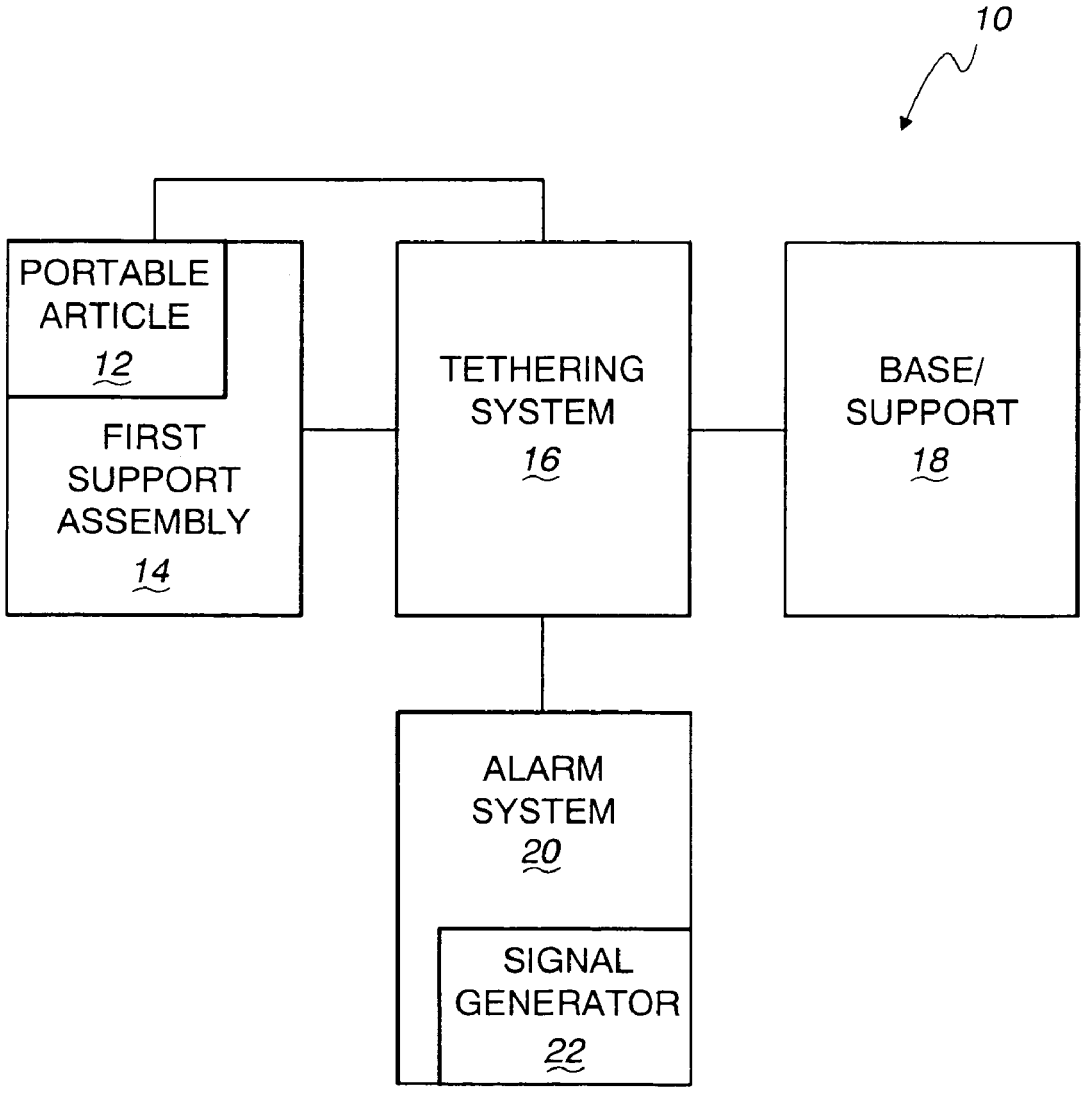
FIG. 1 is a schematic representation of a security system for a portable article, according to the present invention, and including a first support assembly to which the portable article is attached, a tethering system for connecting the first support assembly to a base/support, and an alarm system for generating a detectable signal in the event of a breach of the system.
Figure 2:
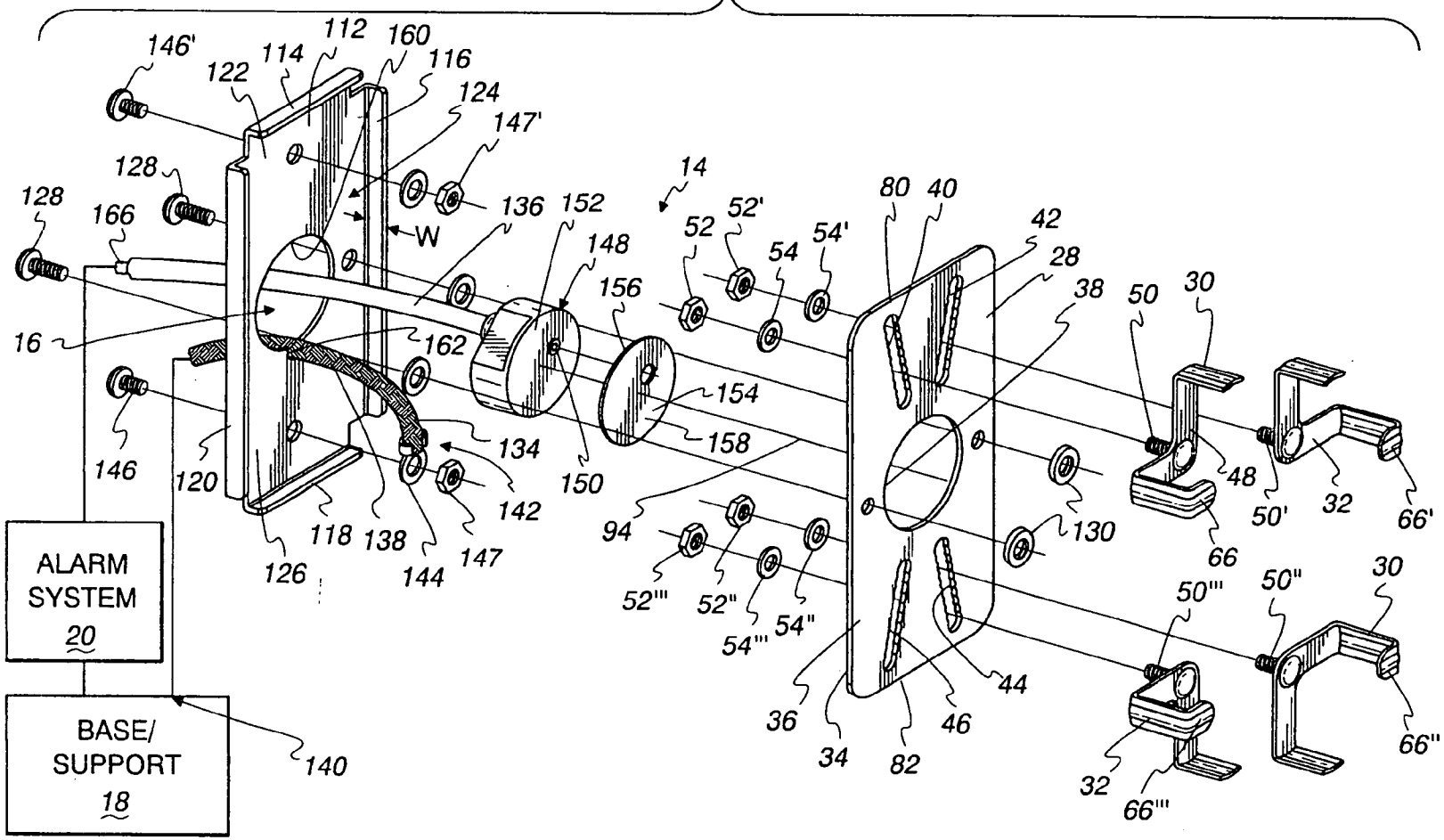
FIG. 2 is a partially schematic, exploded, perspective view of the system in FIG. 1.

Referring initially to FIG. 1, a security system, according to the present invention, is shown at 10. The security system 10 is designed for portable articles 12, such as electronic articles commonly displayed at point of purchase in such a manner that the articles 12 can be picked up and operated by a prospective purchaser. The portable article 12 is shown in generic form since it is intended that it can take virtually any form, be it purely mechanical, electrical, or electromechanical in nature. Further, the portable article 12 is not limited in size. The system 10 is specifically designed to avoid unauthorized removal of the article 12 from a prescribed area, be the article hand holdable or more substantial in terms of its mass, such as a television set, a computer component, or the like.

A first support assembly 14 is attachable to the portable article 12. As explained in greater detail below, the portable article 12 is maintainable in a secured state relative to the first support assembly 14.

A tethering system at 16 connects between the portable article 12 and/or the first support assembly 14 and a base/support 18. As explained in greater detail below, the base/support 18 can be a fixed or a repositionable structure.

The system 10 further includes an alarm system 20 with an associated generator at 22 for a detectable signal indicative of a breach of the security system 10. The alarm system 20 is capable of detecting at least (a) a first system state wherein at least one of the tethering system 16 and alarm system 20 has been reconfigured to allow the portable article 12, in the secured state relative to the first support assembly 14, to be moved beyond a predetermined range away from the base/support 18 and (b) a second state wherein at least one of the tethering system 16 and alarm system 20 has been reconfigured to allow the portable article 12 to be changed from the secured state relative to the first support assembly 14 and moved beyond the predetermined range away from the base/support 18.

Details of one form of the inventive system 10 are shown in FIGS. 2–6. The first support assembly 14 consists of a first wall 28 to which a plurality of connecting elements 30,32 are attached. Exemplary configurations for the connecting elements 30,32 are shown in pending U.S. application Ser. No. 10/803,397, entitled "Security System for Portable Articles", and U.S. Pat. No. 6,700,488, entitled "Security System for a Portable Device". The disclosures in both of these documents are incorporated herein by reference. Other arrangements of one or more connecting elements 30,32, as described herein and shown in the above patent documents, are contemplated. Generally, all that is required is that at least one of the connecting elements be repositionable relative to the first wall 28 to selectively secure and release the portable article 12.

The first wall 28 has a generally rectangular shape with oppositely facing, substantially flat, surfaces 34,36. The first wall 28 has a central through opening 38 and a generally X-shaped arrangement of diagonally extending, elongate slots 40,42,44,46, with the X crossing at the center of the through opening 38.

Exemplary connecting element 30 has a base 48 from which a threaded post 50 projects. The post 50 can be directed through the slot 40 and is pivotable therewithin and translatable therealong. By directing the post 50 through the slot 40, the post 50 is exposed at the surface 34 to accept a nut 52 and washer 54. By tightening the nut 52, the angular orientation of the connecting element 30 can be fixed, as can its particular location along the length of the slot 40. The other connecting elements 30,32 are connected in a similar manner through their associated slots 42,44,46.

The connecting element 30 has portions 58,60 projecting in different directions away from a bight portion 62 at which the threaded post 50 is located. The portion 58 is U-shaped and consists of a base 64 from which spaced legs 66,68 project in substantially parallel relationship. The leg 68 defines part of the base 48. The portion 60 is generally L-shaped and consists of a leg 70, that defines part of the base 64, and a transverse leg 72. The base 64 and leg 72 cooperatively define a receptacle at 74 into which a corner 76 of the portable article 12 can be nested, as shown in FIG. 3.

The connecting elements 30,32, paired at each lengthwise end 80,82 of the first wall 28, are mirror images of each other. Similarly, the paired connecting elements 30,32 at the wall end 80 are mirror images of the paired connecting elements 30,32 at the opposite wall end 82. To understand the operation and function of the connecting elements 30,32, it is necessary only to describe the structure of the exemplary connecting element 30 and its cooperation with the first wall 28.

Figure 3:
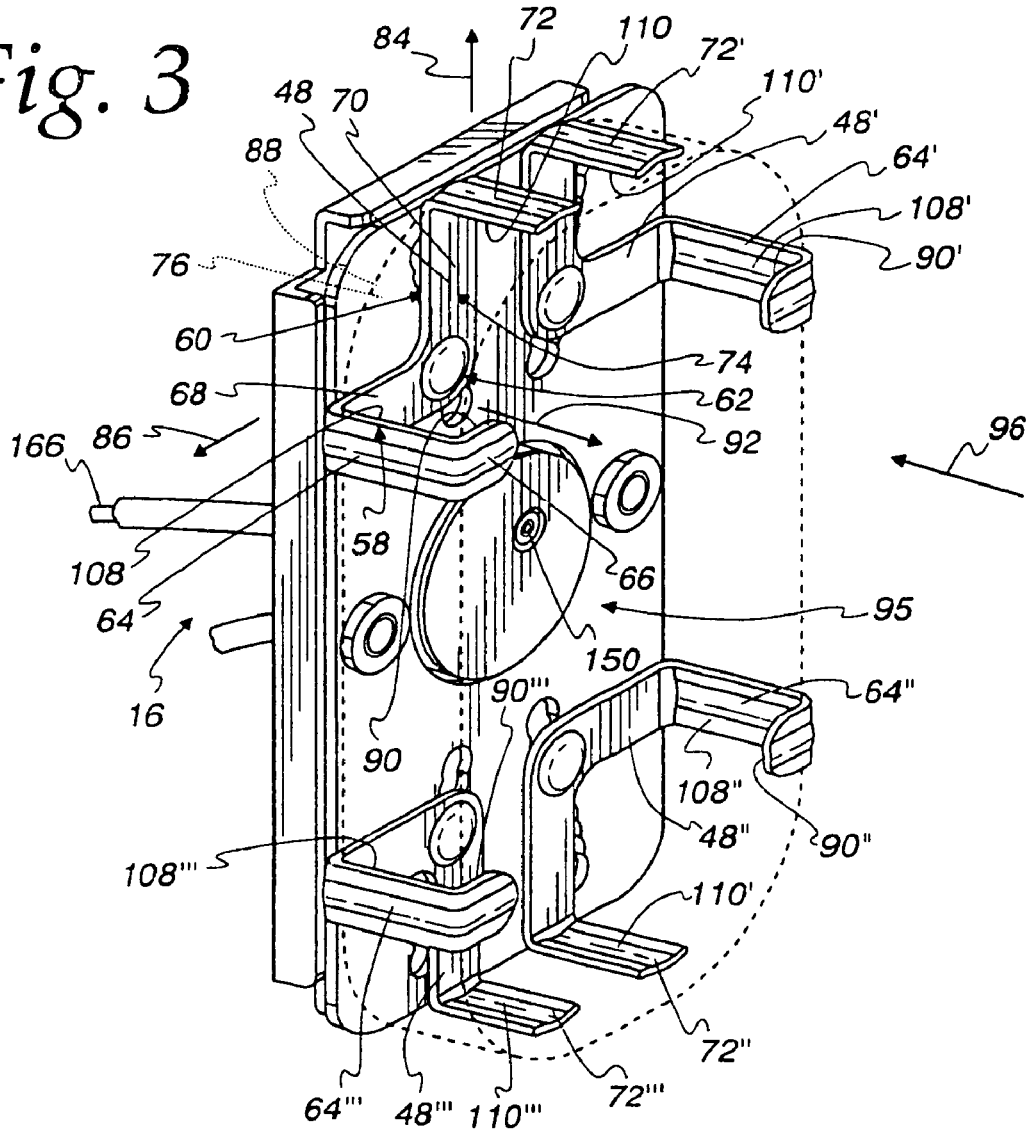
FIG. 3 is an enlarged, fragmentary perspective view of a portable article in a secured state on the first support assembly and showing a portion of the tethering system.

With the portable article 12 nested in the receptacle 74, the leg 72 confines translatory movement of the article 12 in the direction of the arrow 84 in FIG. 3. The base 64 confines translatory movement of the portable article 12 in the receptacle 74 in the direction of the arrow 86. With the portable article 12 nested in the receptacle 74, a surface 88 on the portable article 12 at the wall surface 36 bears upon the base 48 of the connecting element 30. The leg 66 has a surface 90 that faces the base 48 and captively blocks, and thereby maintains, the portable article 12 against separation from the wall 28 in the direction of the arrow 92.

Figure 5:
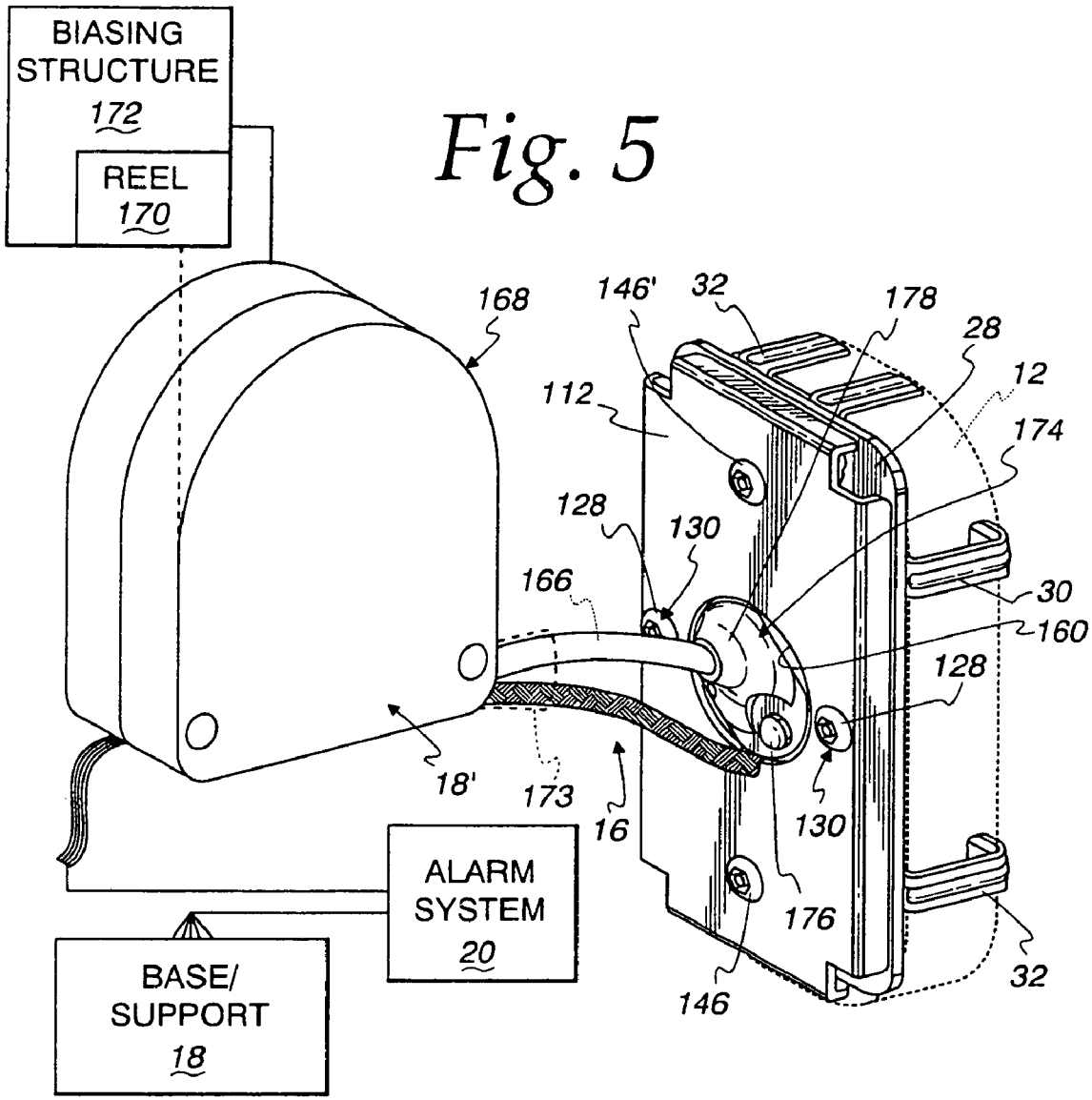
FIG. 5 is an enlarged, partially schematic, perspective view of a modified form of security system, according to the invention, including an intermediate base/support in the form of a housing into which flexible elements on the tethering system can be retracted for purposes of wire management.
Figure 6:
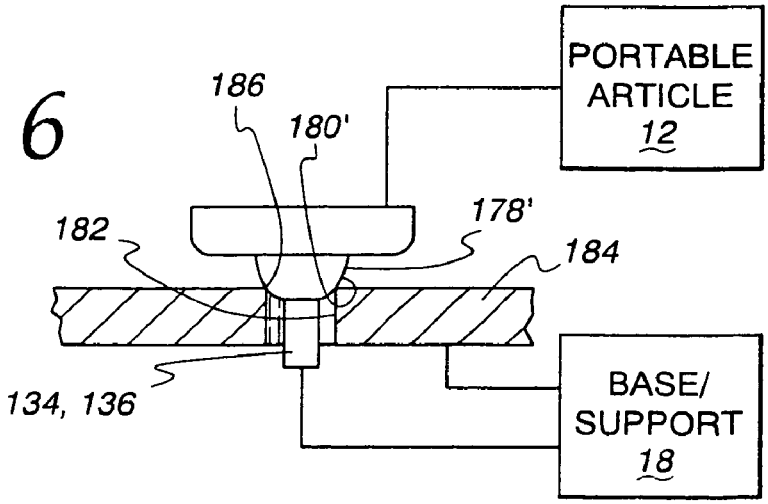
FIG. 6 is a partially schematic view of the inventive security system and shown in the relationship between a sensor on the tethering system and a cross section of a display shelf through which the elongate flexible elements are drawn.

To place the portable article 12 in the secured state of FIGS. 3 and 5, the connecting elements 30,32 can be shifted in their respective slots 40,42,44,46 away from the center 94 of the through opening 38 to effectively enlarge an opening at 95 defined cooperatively by all of the connecting elements 30,32, sufficiently to allow the portable article 12 to be moved in the direction of arrow 96 to be engaged and supported at the wall 28 by the base 48 and the other bases 48',48",48'" on the other connecting elements 30,32. By then sliding the threaded posts 50,50',50",50'" in their respective slots 40,42,44,46, the bases 64,64',64",64'" can be converged in a widthwise direction on the portable article 12, with the legs 72,72',72",72'" simultaneously converged in a lengthwise direction. This represents the secured state for the portable article 12, wherein the article 12 becomes captively held against separation from the bases 48,48',48", 48'" by the leg surfaces 90,90',90",90'" on the connecting elements 30,32.

As previously noted, the configuration of the connecting elements 30,32 is not limited to what is shown herein and described in the other patent documents, incorporated herein by reference. Combinations of fixed and movable connecting elements may be utilized. It is only necessary that the portable article 12 in the secured state be confined against translatory movement and captively held at the first wall 28.

Figure 7:
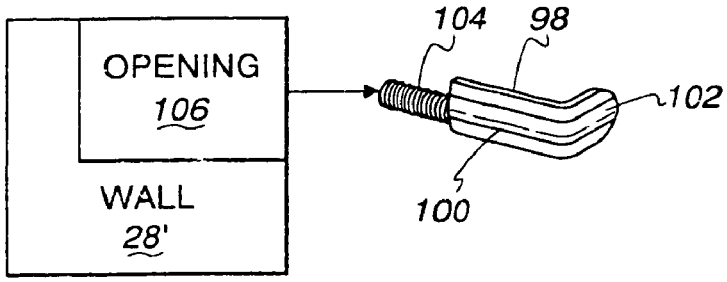
FIG. 7 is an enlarged, partially schematic, perspective view of a modified form of connecting element and supporting wall therefor, according to the invention.

The adjustability of the connecting elements is not a requirement. For example, as shown in FIG. 7, a connecting element 98, corresponding to any of the above-described connecting elements 30,32, has an L shape, including transverse legs 100,102. The leg 100 has an associated threaded post 104. The connecting elements 98 may be mounted to the first wall 28 in the slots 40,42,44,46, or alternatively may be directed into a complementarily-shaped opening 106 in the modified form of wall 28', as shown in FIG. 7.

At least one of the connecting elements 30,32 is preferably movable relative to the wall 28 between (a) a secured position, as shown in FIG. 3, wherein the surfaces 90,90', 90",90'", surfaces 108,108',108",108'" on the bases 64,64', 64",64'"; and surfaces 110,110',110"110'" on the legs 72,72', 72",72'" cooperatively block the portable article 12 from being separated from the wall 28, and (b) an unsecured position, wherein these surfaces do not cooperatively block the portable article 12 from being separated from the wall 28 and the first support assembly 14.

The cooperating threaded post 50 and nut 52 define a setting mechanism which can be tightened to a holding state and loosened to a release state. In the holding state, the connecting element 30 is maintained in a secured position therefor. The threaded posts 50',50",50'" and cooperating nuts 52',52",52'" define like setting mechanisms, each of which has holding and release states. In the release state, the connecting element 30 is movable from a holding position into a release position.

A second wall 112 on the support assembly 14 defines an access assembly. The second wall 112 has peripheral flanges 114,116,118,120, offset from a flat, main body 122. The flanges 114,116,118,120 are abuttable to the surface 34 of the wall 28 so that a chamber at 124 is defined between the surface 34 on the first wall 28 and a facing surface 126 on the second wall 112. The chamber 124 has a depth dictated by the width W of the flanges 114,116,118,120, which is sufficient to accommodate the portions of the threaded posts 50,50',50",50'" projecting through the first wall 28 and the nuts 52,52',52",52'" and washers 54,54',54",54'" thereon.

Figure 4:
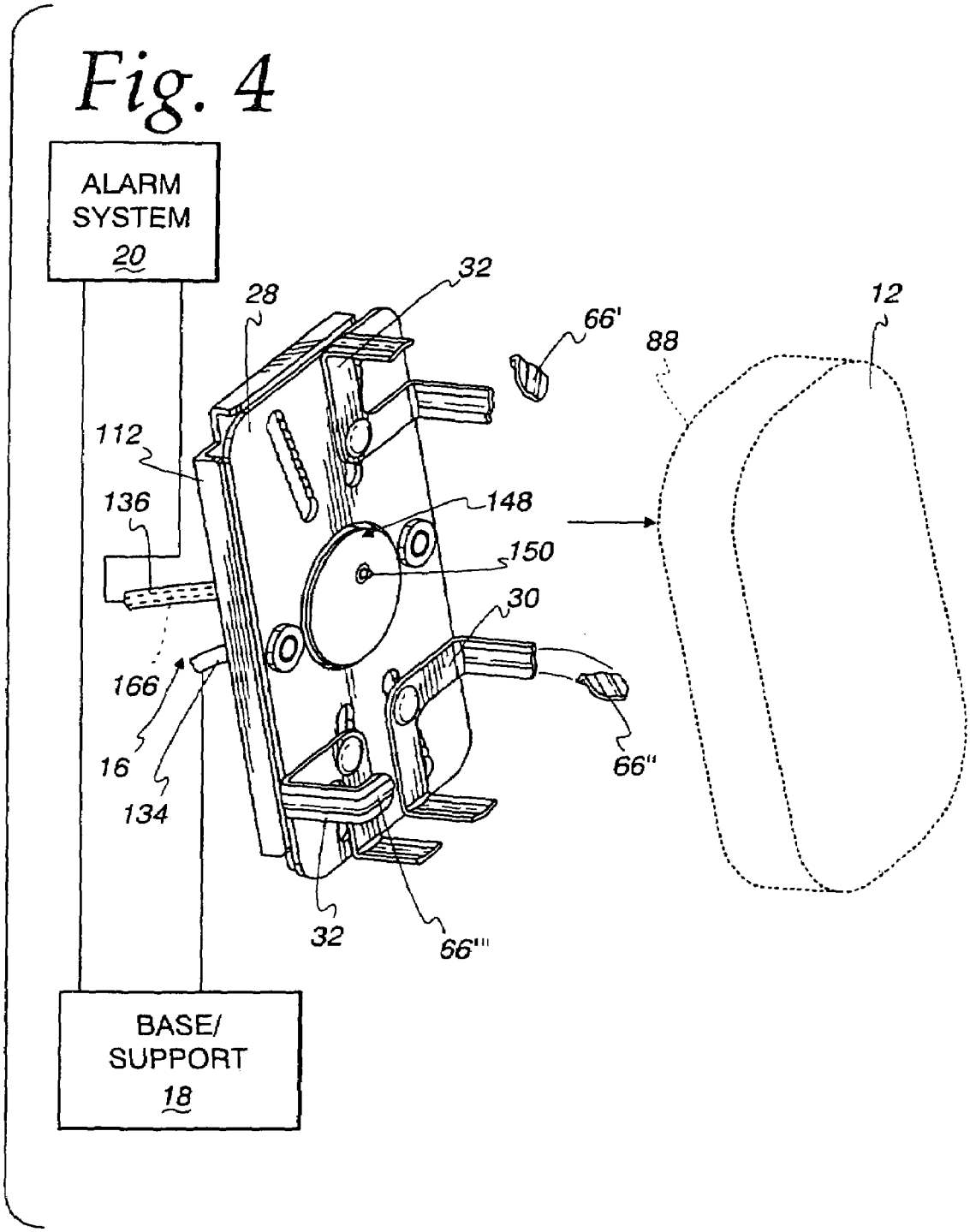
FIG. 4 is an enlarged, partially schematic, perspective view of the system in FIG. 1 with connecting elements on the support assembly severed to allow release of the portable article from the support assembly.

The second wall 112 is maintainable in a first state, as shown in FIGS. 3–5, against the second wall 112 by threaded fasteners 128 directed through the second wall 112 and into nuts 130 at the surface 36 of the first wall 28. In this first state, the second wall 112 blocks access to the setting mechanisms, including the nuts 52,52',52",52'". As a result, a potential thief will not be able to access the nuts 52,52', 52",52'" in a manner to change the setting mechanisms from their holding states into their release states. The fasteners 128 have a tamper-proof head fitting 130 which requires a special tool to operate. Thus, unauthorized separation of the first and second walls 28,112 is avoided.

By loosening the fasteners 128, the second wall 112 can be separated from the first wall 28 to a second state. With the second wall 112 in the second state, access to the nuts 52,52',52",52'" can be gained to allow a reconfiguration of the connecting elements 30,32, as to release the portable article 12 from the secured state, or place the portable article 12 in the secured state.

The tethering system 16 consists of a first elongate flexible element 134 and a second, independent, elongate, flexible element 136. The first elongate flexible element 134 is in the form of a mechanical cable. The cable may be made from wrapped wire strands 138. The cable may be made from hardened or unhardened metal. One end 140 of the mechanical cable 134 is connected to the base/support 18 in any suitable manner well known to those skilled in this art. The opposite end at 142 has a connector 144 joined thereto as by a crimping process. The connector 144 receives a fastener 146 which is directed therethrough and the second wall 112 and is engaged with a nut 147. By tightening the nut 147, the end 142 can be securely fixed within the chamber 124 to the second wall 112.

The second elongate flexible element 136 defines a conductive path between a sensor 148 and the alarm system 20. The structural and functional details of the sensor 148 and alarm system 20 are not critical to the present invention. A suitable construction for the alarm system 20, including the sensor 148, is shown in U.S. Pat. No. 5,172,098, which is incorporated herein by reference. It suffices to say that the sensor 148 has a secured state, wherein the system 10 is armed, and an unsecured state. The sensor 148 is changed from the unarmed state into the armed state by depressing a plunger 150, which is normally biased outwardly to the unsecured state of FIGS. 2 and 4.

The sensor 148 has a flat surface 152 that can be borne against the surface 88 of the portable article 12. By so doing, the plunger 150 is depressed to the secured state, as shown in FIG. 3, wherein the system 10 is armed. The sensor 148 is maintained on the portable article 12 by a pad 154 with adhesive layers 156,158 on opposite sides thereof. The adhesive pad 154 can be interposed between the sensor surface 152 and the surface 88 on the portable article 12.

The support assembly 14, tethering system 16, and portable article 12 are assembled as follows. With the second wall 112 separated from the first wall 28, the sensor 148 is directed through an opening 160 in the second wall 112 that is substantially aligned with the opening 38 through the first wall 28. The end 142 of the mechanical cable 134 is secured to the second wall 112 using the fastener 146 and nut 147. The opening 160 has a contiguous cutout 162 to accept the diameter of the mechanical cable 134 so as to expose the full diameter of the opening 160 to accept the sensor 148. Alternatively, the end 142 of the mechanical cable 134 can be attached to the second wall 112 at a diametrically opposite location with respect to the opening 160, using a fastener 146' and nut 147'.

The portable article 12 can then be attached to the first wall 28 using the connecting elements 30,32. The nuts 52,52',52",52'" are tightened with the portable article 12 in the desired secured state. Preferably, the sensor 148 is adhered to the portable article 12 before the portable article 12 is placed in the secured state. The walls 28,112 are then matched and secured together using the fasteners 128 and nuts 130.

With the system 10, as described above, preferably a continuous circuit is defined by at least one conductive element 166 within the flexible elongate element 136. By interrupting the conductive path in the circuit, the signal generator 22 on the alarm system 20 is caused to produce a detectable signal identifying a system supervisor of a breach. This interruption may be caused by a severance of the elongate flexible element 136 and/or by an extension of the plunger 150 so as to place the sensor 148 in the unsecured state. Thus, if a would-be thief severs the elongate flexible element 136 and mechanical cable 134 to abscond with the support assembly 14 with the portable article 12 secured thereon, the alarm system 20 will alert the system supervisor to the system's breached state. Alternatively, if the would-be thief attempts to separate the portable article 12 from the support assembly 14, the state of the sensor 148 is changed, as an incident of which the alarm system causes the signal generator 22 to alert the system supervisor to a second breached state. This latter state might occur in the event that the connecting elements 30,32 are compromised, as shown in FIG. 4, as by severance of one or more of the legs 66, 66', 66", 66'".

The elongate flexible elements 134,136 determine the range of movement that is permitted for the support assembly 14 relative to the base/support 18. The alarm system 20 may be connected to the base/support 18 or, alternatively, may be independently supported. The base/support 18, as used herein, is intended to encompass not only the particular structure to which the system 10 is integrated, but also surrounding structures which essentially become part of a fixed foundation for the entire system 10.

The invention further contemplates an intermediate base/support 18' in the form of a housing 168, and is shown in FIG. 5. The housing 168 contains a reel 170 around which one or both of the elongate flexible elements 134,136 can be wrapped. A biasing structure 172 normally urges the reel 170 in rotation in a manner that the at least one elongate flexible element 134,136 is retracted into the housing 168, for purposes of wire management.

An optional sleeve 173 surrounds the flexible elements 134,136 to unitize the same over at least a portion of their lengths. This allows the combined flexible elements 134,136 and sleeve 173 to be retracted into the housing 168 as a unit. Details of an exemplary intermediate base/support 18', as shown in FIG. 5, are disclosed in U.S. application Ser. No. 10/740,272, which is incorporated herein by reference.

At least a portion of the sensor 148 resides in the chamber 124. A back side 174 of the sensor 148 is exposed through the second wall opening 160. The back side 174 of the sensor has an LED 176 which generates different colors, depending upon the state of the sensor 148. This allows the system supervisor to do a quick visual inspection to make certain that the system is properly armed and to also locally identify a security breach on a display having a large number of portable articles 12.

The back side 174 of the sensor 148 has a truncated projection 178 with a rounded, convex, peripheral surface 180. With the elongate flexible elements 134,136 drawn through an opening 182, as in a shelf 184 on the base/support 18, the rounded shape the sensor, shown schematically at 148' in FIG. 6, will allow the surface 180' on the projection 178' to rock at the edge 186 at the entry to the opening 182. This facilitates repositioning of the portable article 12 by a user during inspection thereof.

One or both of the flexible elements 134,136 can be extended from the housing 168 to the alarm system 20 and/or base/support 18, as shown in FIG. 5.

While the invention has been described with particular reference to the drawings, it should be understood that various modifications could be made without departing from the spirit and scope of the present invention.

The invention claimed is:

1. In combination:

a portable article;

a first support assembly, the first support assembly comprising at least a first connecting element for maintaining the portable article in a secured state relative to the first support assembly; and a tethering system which connects to the first support assembly and is connectable to a base/support, the tethering system preventing the first support assembly from being moved beyond a predetermined range from a base/support to which the tethering system is connected, the combination further comprising an alarm system, the alarm system capable of detecting at least (a) a first state wherein at least one of the tethering system and alarm system has been reconfigured to allow the portable article, in the secured state relative to the first support assembly, to be moved beyond the predetermined range away from a base/support, and (b) a second state wherein at least one of the tethering system and alarm system has been reconfigured to allow the portable article to be changed from the secured state relative to the first support assembly and moved beyond the predetermined range away from a base/support.

2. The combination according to claim 1 wherein the tethering system comprises a first elongate flexible element and further in combination with a base/support comprising a housing with an associated mechanism for retracting the first elongate flexible element into the housing for thereby changing a distance between the housing and the portable article and first support assembly with the portable article in the secured state relative to the first support assembly.

3. The combination according to claim 2 wherein the mechanism associated with the housing has a reel that is normally biased in rotation around an axis so that the first elongate flexible element is caused to be wrapped around the reel to be retracted into the housing.

4. The combination according to claim 1 wherein the alarm system defines a part of the tethering system.

5. The combination according to claim 1 wherein the alarm system comprises a detectable signal generator and a conductive element that defines a conductive path that, if interrupted, causes the detectable signal generator to generate a detectable signal indicative of a system breach.

6. The combination according to claim 5 wherein the alarm system comprises a sensor with a secured state and an unsecured state, with the sensor attached to the portable article, the sensor is in the secured state, and with the sensor separated from the portable article, the sensor is in the unsecured state.

7. The combination according to claim 6 wherein the first support assembly has a first wall at which the portable article is placed with the portable article in its secured state and the conductive element is directed through the first wall in the first support assembly.

8. The combination according to claim 1 wherein the first support assembly has a first wall at which the portable article is placed with the portable article in its secured state and the first connecting element has a surface which blocks the portable article from being separated from the first wall.

9. The combination according to claim 5 wherein the tethering system further comprises a mechanical cable, independent of the conductive element, and the mechanical cable connects to the first support assembly and is connectable to a base/support.

10. The combination according to claim 9 wherein the mechanical cable and conductive element each have a length and the mechanical cable and conductive element are joined to each other over at least a portion of the lengths of the mechanical cable and conductive element.

11. The combination according to claim 8 wherein the first connecting element is movable relative to the first wall between a secured position wherein the surface on the first connecting element blocks the portable article from being separated from the first wall and an unsecured position wherein the surface on the first connecting element does not block the portable article from being separated from the first wall, and the first support assembly further comprises a setting mechanism which can be placed selectively in a holding state and a release state, the setting mechanism in the holding state maintaining the first connecting element in the secured position, the setting mechanism in the release state allowing the first connecting element to be changed from the holding position into the released position.

12. The combination according to claim 11 wherein the first support assembly further comprises a second connecting element which cooperates with the first connecting element to maintain the portable article in its secured state.

13. The combination according to claim 11 wherein the first support assembly further comprises an access assembly that is changeable between a first state and a second state, the access assembly in the first state blocking access to the setting mechanism to prevent the setting mechanism from being changed from the holding state into the release state, the access assembly in the second state permitting access to the setting mechanism to allow the setting mechanism to be changed from the holding state into the release state.

14. The combination according to claim 13 wherein the access assembly comprises a second wall that is connected to the first wall with the access assembly in the first state.

15. The combination according to claim 14 wherein with the first wall connected to the second wall a chamber is defined between the first and second walls and the setting mechanism resides at least partially in the chamber.

16. The combination according to claim 15 wherein the tethering system further comprises a mechanical cable, independent of the conductive element, the mechanical cable connecting to the first support assembly within the chamber and connectable to a base/support.

17. The combination according to claim 1 further comprising a base/support to which the tethering system connects.

18. The combination according to claim 8 wherein the first connecting element has an L shape with first and second transverse legs, and the first leg defines the surface.

19. The combination according to claim 8 wherein the first connecting element has an L shape with first and second traverse legs, the first leg is attached to the first wall and the second leg blocks shifting of the portable article relative to the wall.

20. The combination according to claim 8 wherein the first connecting element has U shape with spaced, substantially parallel, first and second legs, and the portable article, in the secured state, resides between the first and second legs.

21. The combination according to claim 15 wherein the tethering system further comprises a mechanical cable that is connected to the first support assembly in the chamber.

22. The combination according to claim 7 wherein with the portable article in the secured state, at least a part of the portable article is spaced from a part of the first wall and the sensor resides at least partially in a space defined between the parts of the portable article and first wall.

23. A security system for a portable article, the security system comprising:

a first support assembly comprising at least a first connecting element for maintaining a portable article in a secured state relative to the first support assembly; and a tethering system which connects to the first support assembly and is connectable to a base/support, the tethering system preventing the first support assembly from being moved beyond a predetermined range from a base/support to which the tethering system is connected, the combination further comprising an alarm system, the alarm system capable of detecting at least (a) a first state wherein at least one of the tethering system and alarm system has been reconfigured to allow the first support assembly to be moved beyond the predetermined range away from the base/support; and (b) a second state wherein at least one of the tethering system and alarm system has been reconfigured to allow a portable article to be changed from the secured sate relative to the first support assembly to be moved beyond the predetermined range away from a base/support.

24. The security system for a portable article according to claim 23, further comprising a base/support to which the tethering system is connected.

* * * * *